United States Patent [19]

Hammill

[11] Patent Number: 4,912,801

[45] Date of Patent: Apr. 3, 1990

[54] CAN CLEANING BRUSH

[76] Inventor: Buster C. Hammill, 5279 Cynthia, Springfield, Oreg. 97478

[21] Appl. No.: 288,147

[22] Filed: Dec. 22, 1988

[51] Int. Cl.[4] ..... A46B 5/02

[52] U.S. Cl. ..... 15/160; 15/169; 15/105; 15/106

[58] Field of Search ..... 15/104.04, 105, 106, 15/160, 70, 169, 210, 244.1

[56] References Cited

U.S. PATENT DOCUMENTS

| | | | |
|---|---|---|---|
| 351,091 | 10/1886 | Dessau | 15/169 |
| 1,007,888 | 11/1911 | Parker | 15/180 |
| 2,464,321 | 3/1949 | Konczal | 15/106 UX |
| 2,480,023 | 8/1949 | Holden | 15/160 X |
| 2,603,991 | 7/1952 | Oliver | 15/105 UX |
| 2,645,801 | 7/1953 | Seidner | 15/160 X |
| 2,674,758 | 4/1954 | Fay . | |
| 2,741,786 | 4/1956 | Bressler | 15/105 X |
| 3,205,523 | 9/1965 | Seaver | 15/169 X |
| 3,243,832 | 4/1966 | Allen | 15/180 |
| 3,564,636 | 2/1971 | Tomer . | |
| 3,780,407 | 12/1973 | Hoffecker | 15/169 |
| 4,120,068 | 10/1978 | Kaczmarek . | |
| 4,225,997 | 10/1980 | Thomas et al. | 15/169 X |
| 4,291,431 | 9/1981 | Lewis . | |
| 4,348,060 | 9/1982 | Lewis . | |
| 4,733,423 | 3/1988 | Blatt | 15/160 |
| 4,763,380 | 8/1988 | Sandvick | 15/160 |

*Primary Examiner*—Frankie L. Stinson

*Attorney, Agent, or Firm*—Jerry T. Kearns

[57] ABSTRACT

A brush for cleaning the top surface of beverage cans has a cylindrical body member having a central longitudinal bore. A handle on a first end face of the body has a slotted portion for lifting pull tabs of beverage cans and a bottle opener. A plurality of bristles are secured on a second end face of the body, surrounding the longitudinal bore in a circular pattern. A cylindrical sleeve is received for longitudinal sliding movement around the body for selective engagement around the top portion of a beverage can. The sleeve serves as a guide to assist in proper positioning of the brush. A detent is provided for retaining the sleeve in an extended position.

7 Claims, 3 Drawing Sheets

CAN CLEANING BRUSH

BACKGROUND OF THE INVENTION

1. Field of the Invention

The present invention relates to brushes, and more particularly pertains to a new and improved brush for cleaning the top surface of beverage cans. In grocery stores, taverns, distributorships, delivery trucks and homes around the country, there are large numbers of dirty beverage cans. The contents of the cans are frequently consumed directly therefrom by individuals. The top surfaces of these cans are contaminated from transportation in dirty environments or from other leaking cans. People presently use tissues, paper towels and scouring pads to try and clean the top surface of these cans. The problem is aggravated by the provision of a circular gutter on the top surface of the can which traps dirt therein. The present invention provides a brush for efficiently cleaning these cans prior to consumption of the contents.

2. Description of the Prior Art

Various types of brushes are known in the prior art. A typical example of a can cleaning brush is to be found in U.S. Pat. No. 4,763,380. This patent discloses a circular brush having a plurality of bristles and passages extending therethrough for cleaning the top surface of a beverage can. U.S. Pat. No. 2,674,758, which issued to K Fay on Apr. 13, 1954, discloses a hairbrush having a plurality of bristles and a handgrip configured top portion. U.S. Pat. No. 3,564,636, which issued to H. Tomer on Feb. 23, 1971, discloses a generally circular brush for cleaning dentures. The device includes a pair of brushes mounted within mating containers and adapted to receive a denture between opposed bristle portions of the brushes. U.S. Pat. No. 4,120,068, which issued to P. Kaczmarek on Oct. 17, 1978, discloses a cylindrical brush having a T-shaped handle. Bristles are provided on an exterior cylindrical side wall and on opposite end faces of the brush. U.S. Pat. No. 4,291,431, which issued to J. Lewis on Sept. 29, 1981, discloses a generally hemispherical brush provided with a plurality of bristle tufts. U.S. Pat. No. 4,348,060, which issued to J. Lewis, Jr. on Sept. 7, 1982, discloses a method for making flared tufted brushes in which a plurality of synthetic filament tufts are picked and the ends fused. Simultaneously, the fused ends are mounted parallel on a heat softened, thermoplastic support.

While the above mentioned devices are suited for their intended usage, none of these devices disclose a circular brush having a reciprocal longitudinal sleeve adapted for engagement around the top end portion of a can. Additionally, none of the aforesaid devices disclose a brush for cleaning the top surface of beverage cans combined with bottle and pull tab implements. Inasmuch as the art is relatively crowded with respect to these various types of brushes, it can be appreciated that there is a continuing need for and interest in improvements to such brushes, and in this respect, the present invention addresses this need and interest.

SUMMARY OF THE INVENTION

In view of the foregoing disadvantages inherent in the known types of brushes now present in the prior art, the present invention provides an improved can cleaning brush. As such, the general purpose of the present invention, which will be described subsequently in greater detail, is to provide a new and improved can cleaning brush which has all the advantages of the prior art brushes and none of the disadvantages.

To attain this, representative embodiments of the concepts of the present invention are illustrated in the drawings and make use of a brush for cleaning the top surface of beverage cans with a cylindrical body member having a central longitudinal bore. A handle on a first end face of the body has a slotted portion for lifting pull tabs of beverage cans and a bottle opener. A plurality of bristles are secured on a second end face of the body, surrounding the longitudinal bore in a circular pattern. A cylindrical sleeve is received for longitudinal sliding movement around the body for selective engagement around the top portion of a beverage can. The sleeve serves as a guide to assist in proper positioning of the brush. A detent is provided for retaining the sleeve in an extended position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved can cleaning brush which has all the advantages of the prior art brushes and none of the disadvantages.

It is another object of the present invention to provide a new and improved can cleaning brush which may be easily and efficiently manufactured and marketed.

It is a further object of the present invention to provide a new and improved can cleaning brush which is of a durable and reliable construction.

An even further object of the present invention is to provide a new and improved can cleaning brush which is susceptible of a low cost of manufacture with regard to both materials and labor, and which accordingly is then susceptible of low prices of sale to the consuming public, thereby making such brushes economically available to the buying public.

Still yet another object of the present invention is to provide a new and improved can cleaning brush which provides in the apparatuses and methods of the prior art some of the advantages thereof, while simultaneously overcoming some of the disadvantages normally associated therewith.

Still another object of the present invention is to provide a new and improved can cleaning brush for cleaning the top surface of beverage cans prior to consumption of the can contents.

Yet another object of the present invention is to provide a new and improved can cleaning brush having a reciprocal longitudinal sleeve for selective retraction, exposing the brush bristles, or for selected extension to engage a top portion of a beverage can.

Even still another object of the present invention is to provide a new and improved can cleaning brush having a handle including implements for opening pull tabs and bottle caps.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
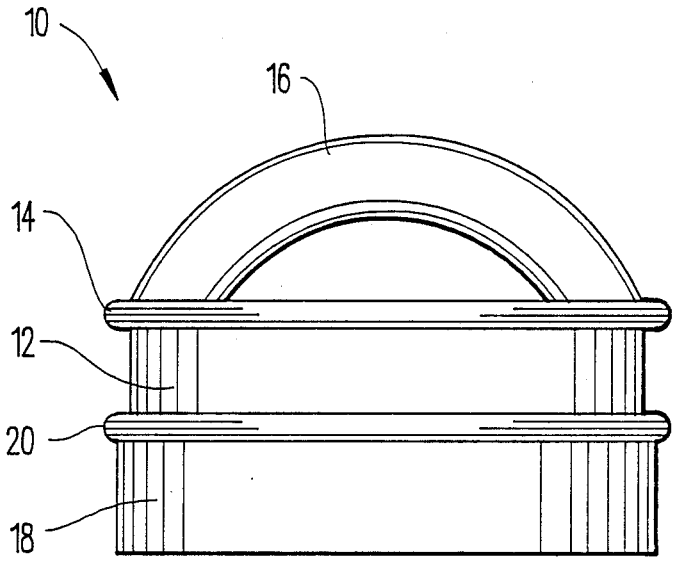
FIG. 1 is a side view of the can cleaning brush according to the first embodiment of the present invention.

With reference now to the drawings, and in particular to FIG. 1 thereof, a new and improved can cleaning brush embodying the principles and concepts of the present invention and generally designated by the reference numeral 10 will be described.

More specifically, it will be noted that the first embodiment 10 of the invention includes a cylindrical body member 12. A handle 16 is secured on a first end face of the body member 12. A cylindrical sleeve 18 is received for reciprocal longitudinal sliding movement around the body member 12. A radially outwardly extending circumferential rib 14, adjacent the first end face of the body member 12 limits upward axial retraction of the sleeve 18. A similar rib 20 is provided adjacent an upper end of the sleeve 18.

Figure 2:
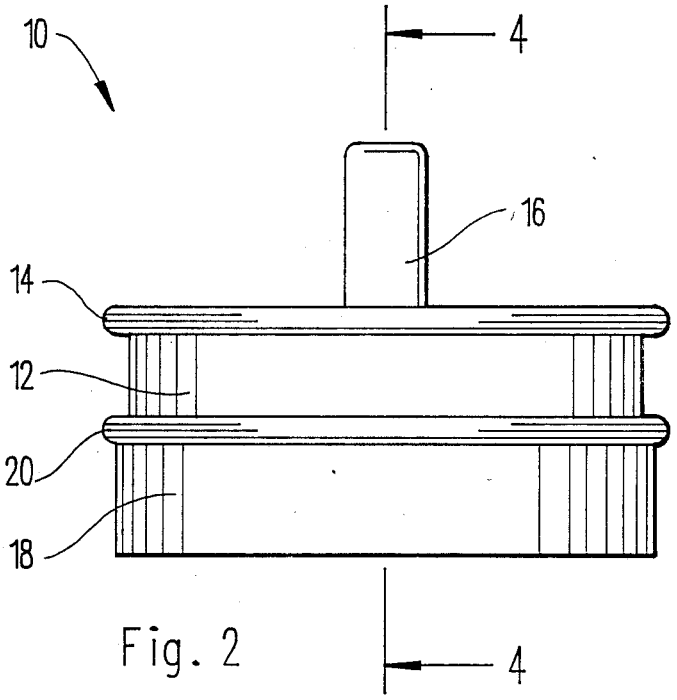
FIG. 2 is a side view, rotated 90 degrees with respect to FIG. 1, of the can cleaning brush according to the first embodiment of the present invention.

FIG. 2 provides a side view, rotated 90 degrees from the position illustrated in FIG. 1. The sleeve 18 is illustrated in an axially extended position.

Figure 3:
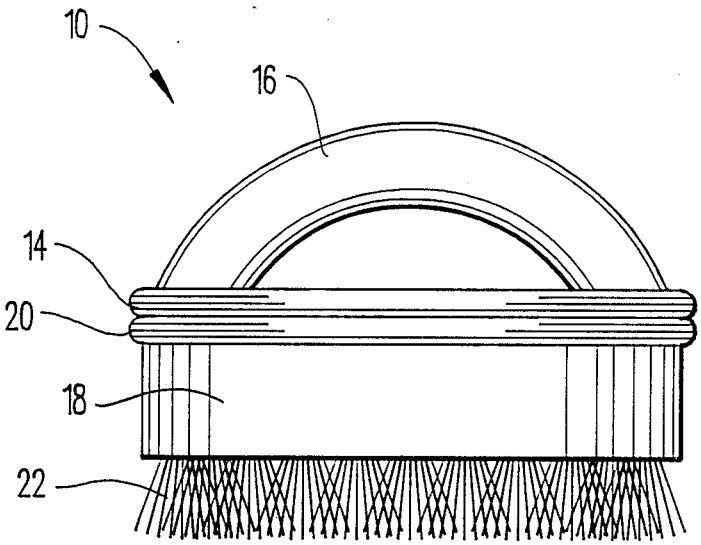
FIG. 3 is a side view of the can cleaning brush, with the axially reciprocal sleeve in a retracted position.

FIG. 3 provides a side view which illustrates the sleeve 18 in an axially retracted position, exposing a plurality of bristles 22 secured in a circular pattern on a second end face of the body member 12.

Figure 4:
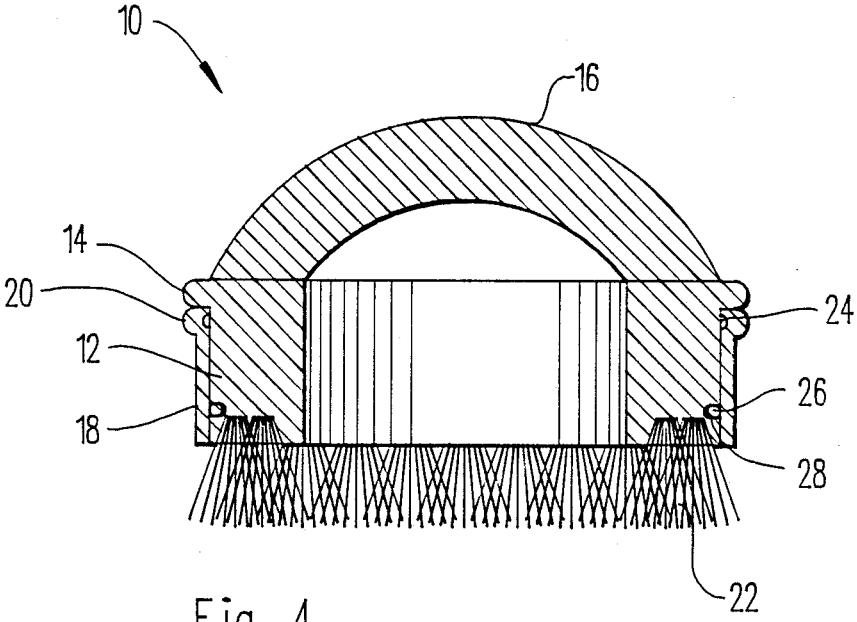
FIG. 4 is a cross sectional view, taken along line 4—4 of FIG. 2.

FIG. 4 illustrates a transverse cross sectional view of the brush 10, which illustrates the central longitudinal bore 30 provided through the body member 12. The bristles 22 are disposed in a circular array around the longitudinal bore 30. An O-ring 26 is secured in a circumferential groove 28 around the body member 12, adjacent the second end face thereof. A cooperating circumferential groove 24 is provided in an interior side wall of the sleeve 18, adjacent the rib 20, for engagement with the O-ring 26 for retaining the sleeve 18 in an axially extended position. The O-ring 26 also serves to provide a sufficient frictional engagement to retain the sleeve 18 around the body member 12. The brush 10 is preferably manufactured from a durable plastic material. The bristles 22 are approximately ⅜ inches in height and are formed from a flexible synthetic material. The body member 12 is dimensioned to fit the top surface of a beverage can which is 2½ inches in diameter. The bristles 22 are disposed in a circular ring having a ½ inch width. The central circular bore 30 is approximately 1½ inches in diameter. The bore 30 allows water to be directed to the top surface of a can by a home faucet when the brush 10 is positioned over the top surface of the can. This facilitates cleaning of the can top surface. In use, the sleeve 18 is extended and serves as a guide which receives the top portion of a can to be cleaned. The sleeve 18 may be retracted to utilize the brush for general cleaning.

Figure 5:
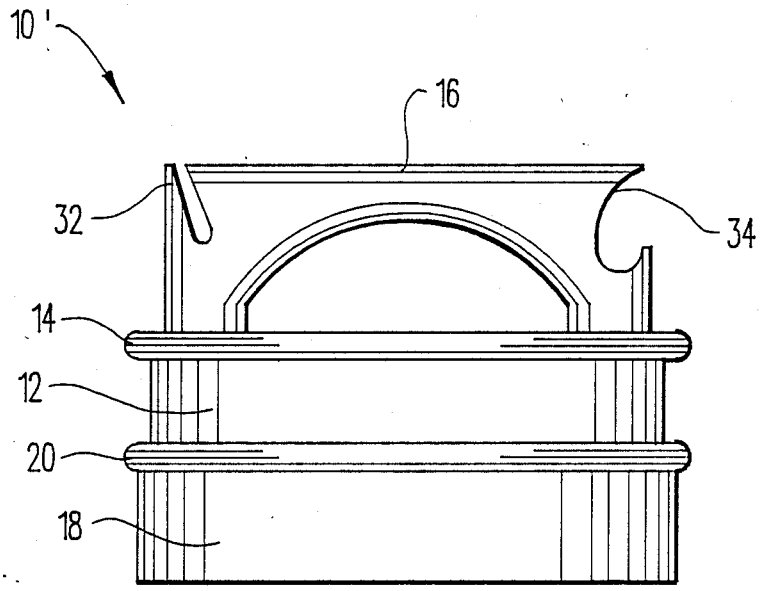
FIG. 5 is a side view illustrating a can cleaning brush according to a modified second embodiment of the present invention.

FIG. 5 illustrates a slightly modified second embodiment 10′ of the present invention. The second embodiment 10′ is identically constructed as previously described with reference to the first embodiment 10, and the same reference numerals have been utilized to identify similar parts. The second embodiment 10′ has a handle 16 which includes a notched portion 32 adjacent one end dimensioned for engagement with pull tabs utilized on conventional beverage cans. A bottle opener 34 is provided on an opposite end of the handle 16. Thus, the brush 10′ is a multi-purpose beverage container cleaning and opening implement.

Figure 6:
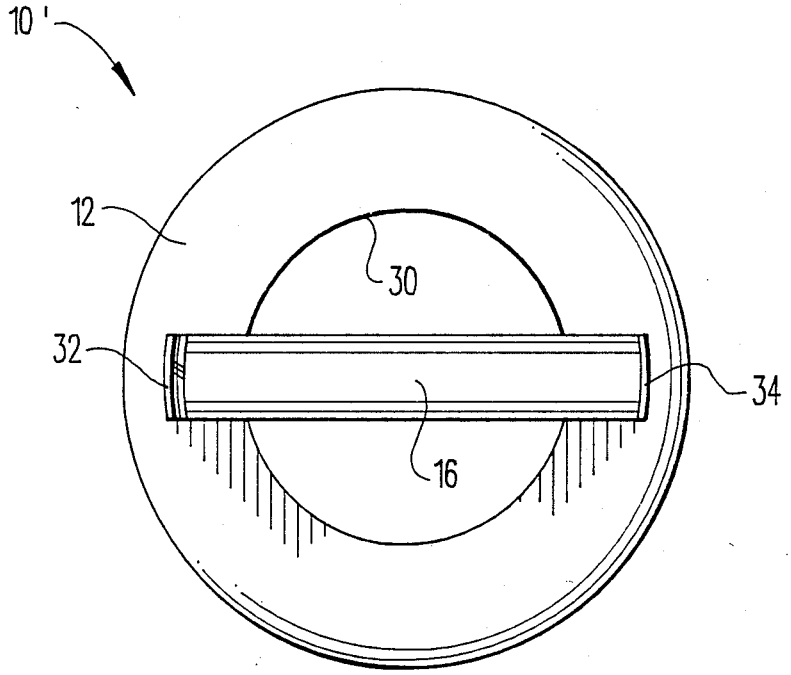
FIG. 6 is a top end view of the can cleaning brush of FIG. 5.

FIG. 6 illustrates a top end view of the second embodiment 10′ of the present invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A can cleaning brush for cleaning the top surface of beverage cans, comprising:

a cylindrical body member;

a central longitudinal passage formed through said body member;

a handle on a first end face of said body member;

a plurality of bristles on an opposite end face of said body member;

a cylindrical sleeve received for reciprocal longitudinal sliding movement around said body member; and a cooperating annular groove in said sleeve for retaining said sleeve in an axially extended position.

2. The can cleaning brush of claim 1, further comprising a slot on said handle for lifting pull tabs of beverage cans.

3. The can cleaning brush of claim 1, further comprising a bottle opener on said handle.

4. A can cleaning brush for cleaning the top surface of beverage cans, comprising:

a cylindrical body member;

a central longitudinal passage formed through said body member;

a handle on a first end face of said body member;

a plurality of bristles on an opposite end face of said body member;

a cylindrical sleeve received for reciprocal longitudinal sliding movement around said body member; and a radially outwardly extending circumferential rib on said body member for limiting axial retraction of said sleeve.

5. The can cleaning brush of claim 4, further comprising a slot on said handle for lifting pull tabs of beverage cans.

6. The can cleaning brush of claim 4, further comprising a bottle opener on said handle.

7. A can cleaning brush for cleaning the top surface of beverage cans, comprising:

a cylindrical body member having a central longitudinal bore;

a handle on a first end face of said body member;

a slotted portion on said handle for lifting pull tabs of beverage cans;

a bottle opener on said handle;

a plurality of bristles on a second end face of said body member, said bristles disposed in a circular pattern surrounding said central bore;

a cylindrical sleeve received for reciprocal longitudinal sliding movement around said body member;

a radially outwardly extending circumferential rib on said body member for limiting axial retraction of said sleeve;

an O-ring secured in a circumferential groove around said body member; and a cooperating circumferential groove in an interior side wall of said sleeve for engagement with said O-ring for retaining said sleeve in an axially extended position.

* * * * *